US006592713B2

(12) United States Patent
Ahoniemi

(10) Patent No.: US 6,592,713 B2
(45) Date of Patent: Jul. 15, 2003

(54) METHOD OF PRODUCING A NONWOVEN MATERIAL

(75) Inventor: Hannu Ahoniemi, Landvetter (SE)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 10/020,221

(22) Filed: Dec. 18, 2001

(65) Prior Publication Data

US 2002/0088099 A1 Jul. 11, 2002

Related U.S. Application Data

(60) Provisional application No. 60/255,900, filed on Dec. 18, 2000.

(30) Foreign Application Priority Data

Dec. 18, 2000 (SE) ..... 0004687-0

(51) Int. Cl.[7] ..... D04H 5/08; B32B 31/16

(52) U.S. Cl. ..... 162/103; 162/129; 162/125; 162/115; 28/104; 264/209.5; 264/165; 264/198; 264/479

(58) Field of Search ..... 162/103, 108, 162/109, 111–113, 115, 197, 141, 149, 204, 146, 123, 125, 129; 442/324; 428/195, 134; 28/104; 264/518, 544, 165, 479, 198, 208, 210, 288, 209.5

(56) References Cited

U.S. PATENT DOCUMENTS

| | | | | | |
|---|---|---|---|---|---|
| 1,582,838 | A | * | 4/1926 | Lorenz | 162/113 |
| 1,676,759 | A | * | 7/1928 | Widmer | 100/74 |
| 1,823,877 | A | * | 9/1931 | Cannard | 162/113 |
| 2,008,182 | A | * | 7/1935 | Kemp | 162/197 |
| 3,207,657 | A | * | 9/1965 | Wagner et al. | 162/206 |
| 3,485,706 | A | * | 12/1969 | Evans | 162/115 |
| 3,494,821 | A | * | 2/1970 | Evans | 162/115 |
| 3,905,864 | A | * | 9/1975 | Curry et al. | 162/133 |
| 4,443,297 | A | | 4/1984 | Cheshire et al. | |
| 4,711,751 | A | * | 12/1987 | Tipton | 264/159 |
| 4,758,466 | A | * | 7/1988 | Dabi et al. | 422/338 |
| 4,775,579 | A | | 10/1988 | Hagy et al. | |
| 4,950,531 | A | * | 8/1990 | Radwanski et al. | 442/351 |
| 5,385,775 | A | * | 1/1995 | Wright | 442/183 |
| 5,573,841 | A | * | 11/1996 | Adam et al. | 428/219 |
| 5,730,923 | A | * | 3/1998 | Hassenboehler et al. | 264/479 |
| 6,103,061 | A | * | 8/2000 | Anderson et al. | 162/108 |
| 6,146,499 | A | * | 11/2000 | Lin et al. | 162/109 |
| 2001/0042949 | A1 | * | 11/2001 | Falk et al. | 264/518 |

FOREIGN PATENT DOCUMENTS

| | | |
|---|---|---|
| EP | 326771 | 8/1989 |
| EP | 333211 | 9/1989 |
| EP | 333228 | 9/1989 |
| GB | 1 329 409 | 9/1973 |
| WO | 96/02701 | 2/1996 |
| WO | 99/22029 | 5/1999 |

* cited by examiner

*Primary Examiner*—Jose A. Fortuna
(74) *Attorney, Agent, or Firm*—Burns, Doane, Swecker & Mathis, L.L.P.

(57) ABSTRACT

Method for producing a nonwoven material comprising at least one layer of continuous filaments, such as spunbond- or meltblown fibers. A first web of continuous filaments (19) are laid on a wire (14) or other permeable support member having a resilient extensibility in the transverse direction and which substantially resumes its original dimension when the extension is discontinued, that the wire is stretched in the transverse direction to at least 120% of its original width when the continuous filaments are laid on the wire. The stretching is discontinued after the continuous filaments have been laid on the wire.

10 Claims, 1 Drawing Sheet

METHOD OF PRODUCING A NONWOVEN MATERIAL

This application claims the benefit of Provisional application No. 60/255,900 filed on Dec. 18, 2000.

TECHNICAL FIELD

The present invention refers to a method of producing a nonwoven material comprising at least one layer of continuous filaments, such as spunbond- or meltblown filaments.

BACKGROUND OF THE INVENTION

Nonwoven materials are produced in many different ways, at which fibres either in the form of continuous filaments or staple length fibres are laid as a web on a wire or other permeable carrier element, and are bonded together with an appropriate bonding technique. The fibrous web can be dry laid, wet laid or foam formed, the latter involving that the fibres are kept dispersed in a foam. Bonding may be provided by the fact that the fibres or filaments as they are laid on the wire are still hot and will adhere to each other. It is also possible to heat the fibrous web from the outside so that at least a part of the fibres or filaments in the fibrous web are melted to become adhering. Bonding can also be provided with different types of chemical bonding agent or mechanically. The latter includes techniques like needling and so called hydroentangling or spunlacing, which involves that the fibres are entangled by means of very fine water jets under high pressure. Several rows of water jets are directed against the fibrous web, which is supported by a moveable wire. The entangled fibrous web is then dried. The fibrous web may either by dry laid, wet laid or foam formed. Spunlace materials may be produced in high qualities at a reasonable cost and have a high absorptive capacity. They are used for example as wiping material for household or industrial use, as disposable material in healthcare and hygiene etc.

Through for example EP-B-0 333 211 and EP-B-0 333 228 it is known to hydroentangle a fibrous mixture in which one of the fibrous components are meltblown fibres or filaments. The base material, i.e. the fibrous material that is exerted to the hydroentanglement, either consists of two pre-shaped fibrous layers wherein one layer consists of meltblown fibres or of a so called coform material in which an essentially homogeneous mixture of meltblown fibres and other fibres are air laid on a wire and then exerted to hydroentanglement.

Through WO 99/22059 it is known to foam form a fibrous web of natural fibres and/or synthetic staple fibres and to hydroentangle the foamed fibrous dispersion with continuous filaments, such as meltblown- or spunbond fibres, for forming a composite material in which the continuous filaments are well integrated with the other fibres.

When laying continuous filaments, such as spunbond- or meltblown fibres, on the permeable support member, e g the wire, it is necessary to quickly remove the air between the filaments. The wire should thus have high air permeability and an open structure. If short fibres, e g synthetic staple fibres or pulp fibres, are then to be laid on top of the continuous filaments, it is however desired to have a tighter wire structure in order to avoid loss of a considerable amount of the short fibres during drainage. However the drainage capacity should be sufficient to provide an effective drainage of the fibrous web. One way of solving the problem of having a very open wire with high air permeability when laying the continuous filaments and a tighter wire when laying the shorter fibres is of course to form the different fibrous webs on different wires. This is however costly and makes the process expensive and complicated

Object and Most Important Features of the Invention

The object of the present invention is to provide a method of producing a nonwoven material comprising at least one layer of continuous filaments, such as spunbond- or meltblown fibres, and wherein the problem of laying the continuous filaments on a wire having a very open structure and a high air permeability, while the continued process, such as bonding of the fibrous web and/or combining it with other fibres, is made on a wire having a tighter structure. This has according to the invention been provided by laying a first web of continuous filaments on a wire or other permeable support member having a resilient extensibility in the transverse direction and which substantially resumes its original dimension when the extension is discontinued, that the wire is stretched in the transverse direction to at least 120% of its original width when the continuous filaments are laid on the wire, that the stretching is discontinued after the continuous filaments have been laid on the wire.

Preferably the wire is stretched in the transverse direction to at least 130%, more preferably to at least 150% of its original width when the continuous filaments are laid on the wire.

According to a preferred embodiment of the invention a second web of natural and/or synthetic staple fibres is laid on top of said first web of continuous filaments after the stretching has been discontinued. This second fibrous web may contain cellulose fibres.

Said second fibrous web may be dry-, wet- or foam formed

According to a preferred embodiment the different fibrous webs are hydroentangled together to form a composite material, in which the different fibre types are well integrated with each other.

DESCRIPTION OF DRAWINGS

The invention will in the following be closer described with reference to an embodiment shown in the accompanying drawing.

The FIGURE shows schematically a perspective view an perspective view of a device for producing a hydroentangled nonwoven material according to the invention

DESCRIPTION OF EMBODIMENTS

Figure 1:
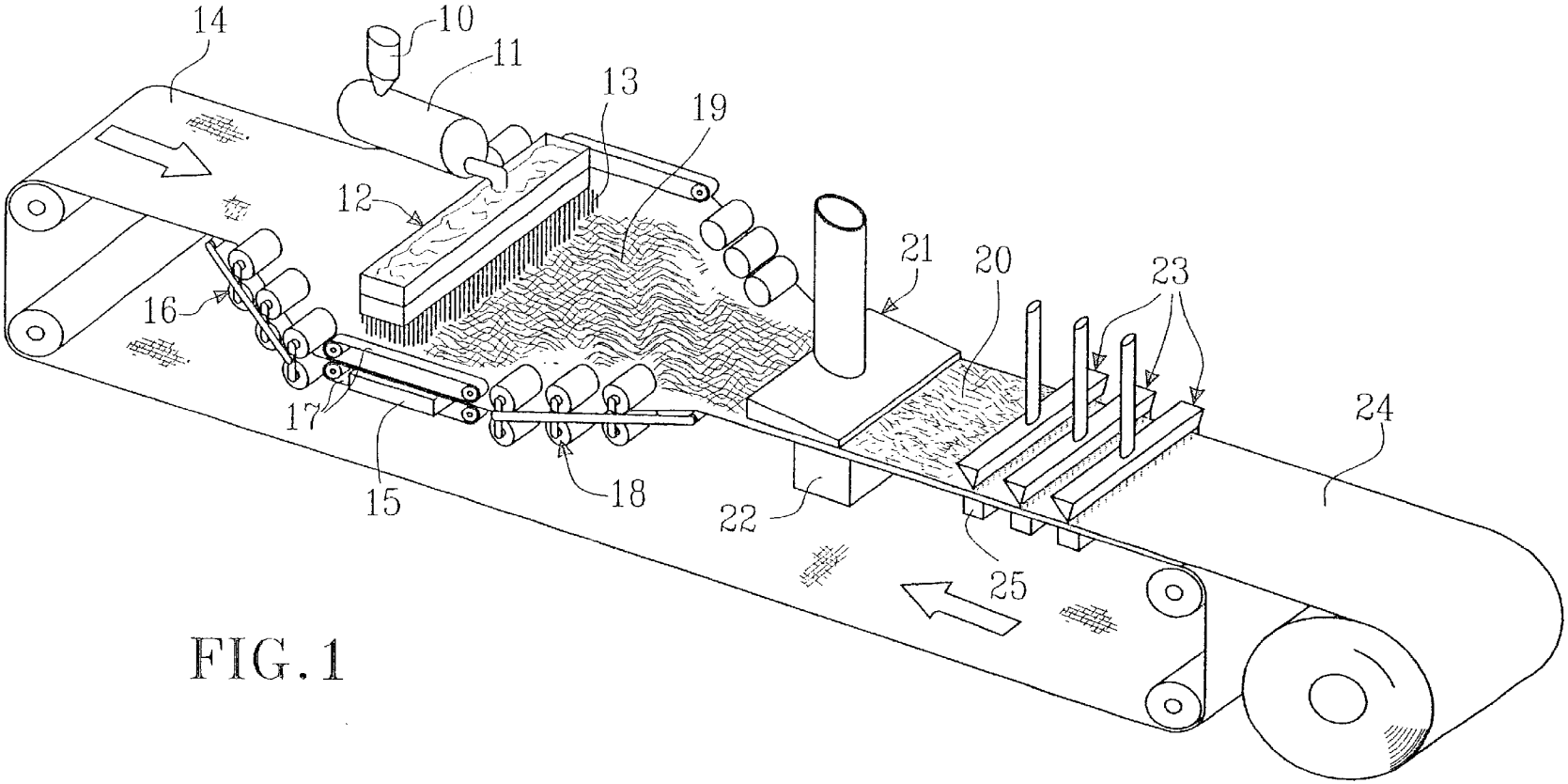

The drawing shows schematically a device for producing a hydroentangled composite material in accordance with the method of the invention. A thermoplastic polymeric material, for example in the form of pellets are via a feeding device 10 fed into a heating unit 11, in which the material is heated to a temperature which is sufficient for melting the polymeric material. The polymeric melt is pressed into a spinning unit 12, from which the molten polymer is extruded out through a plurality of small holes of capillary size, at which more or less continuous filaments 13 are formed from the extruded polymeric melt. The filaments 13 are deposited on an endless wire 14 or other permeable band shaped member. Suction boxes 15 under the wire 14 removes excess air and contribute in keeping the filaments on the wire. The filaments form after cooling a united fibrous web. Since the filaments are laid on the wire in an at least partly molten condition the filaments will adhere to each other in the crossing areas. In certain cases however the filaments will solidify before they are laid on the wire and then they will not adhere to each other.

Principally all thermoplastic polymers can be used for producing such continuous filaments. Examples of useful polymers are polyolefins, such as polyethylene and polypropylene, polyamides, polyesters and polylactides. Copolymers of these polymers may of course also be used, as well as natural polymers with thermoplastic properties.

When producing so called meltblown materials converging air streams are directed towards the polymer streams so that these are drawn out into continuous filaments with a very small diameter. The fibres may be microfibres or macrofibres depending on their dimension. Microfibres have a diameter of up to 20 $\mu$m, and usually are in the interval 2 to 12 $\mu$m in diameter. Macrofibres have a diameter or more than 20 $\mu$m, fro example between 20 and 100 $\mu$m.

Spunbond fibres are produced in a somewhat different way by cooling and stretching the extruded filaments into an appropriate diameter. The fibre diameter is usually above 10 $\mu$m, for example between 10 and 100 $\mu$m.

According to the embodiment shown in the drawing the continuous filaments 13 are laid directly on the wire 14 where they form a relatively loose, open thin fibrous web 19. Shortly before laying the continuous filaments 13 the wire 14 is stretched in transverse direction by clamping its edges between oblique rolls 16. The wire is held in its stretched condition by clamping its edges between a pair of band shaped members 17, alternatively between rolls. The wire 14 is then admitted to resume its non-stretched condition by clamping its edges between rolls 18 which are oblique in an opposite direction as compared to the rolls 16. The edges of the wire 14 may be specially designed to cooperate with the clamping means 16, 17 and 18.

The resilient extensibility of the wire 14 may be achieved by using a weaving- or knitting or warp knitting technique providing the desired extensibility. Alternatively or besides elastic wire threads may be used.

Instead of a wire a permeable (perforated) band-shaped support member made of an elastic polymeric material may be used for providing the desired resilient extensibility. For the sake of simplicity only the term wire has been used in the following.

The material in the wire 14 should have such a degree of resilient extensibility in transverse direction that in a test in a Lloyd tensile strength meter of a strip of the material having a width of 15 mm, with a 50 mm clamping length and 60 mm/min tensile speed, an extension of at least 20%, preferably at least 30% and more preferably at least 50% is obtained, with a force of 10 N. The extensibility in longitudinal direction should however be insignificant.

The wire 14 should have a high elasticity so that it resumes substantially its original dimension when said force ceases. It is herewith noted that it is normal that a resilient material after a first extension does not completely resume its original dimension. However at subsequent extensions the resilient material should substantially resume the dimension it had before the extension.

The wire 14 is stretched in transverse direction to at least 120%, preferably at least 130% and more preferably at least 150%, of its original width when the continuous filaments 13 are laid on the wire, at which this will present a more open and more air permeable structure as compared to its original structure. Shortly after laying the continuous filaments 13 the stretching of the wire 14 is discontinued and it is admitted to resume its original width. This means that the fibrous web 19 is foreshortened resulting in an increase of bulk and basis weight On top of the fibrous web 19 of the continuous filaments a second fibrous web is laid, which in the embodiment shown is a foam formed fibrous web 20 from a headbox 21. Foam forming means that a fibrous web is formed from a dispersion of fibres in a foamed liquid containing water and a surfactant. The foam forming technique is disclosed for example in GB 1,329,409, U.S. Pat. No. 4,443,297 and in WO 96/02701. A foam formed fibrous web has a high degree of uniformity in the fibre formation. For a more detailed description of the foam forming technique reference is made to the above mentioned documents. Through the intensive foaming effect there will already in this step be a mixing of the continuous filaments into the foamed fibre dispersion.

Fibres of many different kinds and in different mixture proportions may be used for forming the foam formed fibrous web. Thus pulp fibres or mixtures of pulp fibres and synthetic fibres, for example polyester, polypropylene, rayon, lyocell, may be used. As an alternative to synthetic fibres natural fibres having a long fibre length, for example more than 12 mm, may be used, such as seed hair fibres, for example cotton, kapok and milkweed; leaf fibres, for example sisal, abaca, pineapple, New Zealand hamp, or bast fibres, for example flax, hamp, ramie, jute, kenaf. Varying fibre lengths can be used and with foam forming technique longer fibres may be used than what is possible in conventional wet laying of fibrous webs. As a replacement for pulp fibres vegetable fibres with a short fibre length may be used, for example esparto-grass, reed canary grass and straw from corn.

For a closer description of the production of a composite material consisting of continuous filaments and foam formed fibres reference is made to WO 99/22059.

The foam is sucked through the wire 14 and through the fibrous web 19 of continuous filaments laid on the wire, by means of suction boxes 22 arranged under the wire. The integrated fibrous web 20 of continuous filaments and other fibres are then hydroentangled together while still supported on the wire 14, by means of a hydroentangling unit 23 and form herewith a composite material 24. If desired the fibrous web may before the hydroentangling be transferred to a special entangling wire, which if desired may be patterned for forming a patterned nonwoven material. The hydroentangling unit 23 comprises several rows of nozzles from which very fine water jets under high pressure are directed against the fibrous web and provides a hydroentangling thereof. Suction boxes 25 are arranged under the wire 14 just opposite the entangling unit 23.

For a more detailed description of the hydroentangling- or as it is also called the spunlace technique reference is made to for example CA patent 841,938.

The energy supply at the hydroentangling is preferably in the interval 50–300 kWh/ton.

Hydroentangling is preferably made in known manner from both sides of the fibrous material (not shown) at which a more homogeneous material equal on both sides is obtained.

After hydroentangling the material 24 is dried and rolled. The finished material is then converted in a known manner to a desired format and packed.

The fibrous web 20 which is integrated with the fibrous web 19 of continuous filaments can also be a wet- or dry formed fibrous web. It would also be possible to lay further fibrous webs after the fibrous web 20, said fibrous webs being combined with the previously laid fibrous webs in the subsequent bonding station 23.

Bonding of the fibrous webs can be made by another optional technique than hydroentangling, such as by means of heat, chemicals and or by needling.

What is claimed is:

1. A method for producing a nonwoven material having at least one layer of continuous filaments, the method comprising laying a first web of continuous filaments on a wire or other permeable support member having a resilient extensibility in a transverse direction and which substantially resumes its original dimension when the extension is discontinued, wherein the wire is stretched in the transverse direction to at least 120% of its original width when the continuous filaments are laid on the wire, and discontinuing the stretching after the continuous filaments have been laid on the wire.

2. The method as claimed in claim 1, wherein the wire is stretched to at least 130% of its original width when the continuous filaments are laid on the wire.

3. Method as claimed in claim 1, wherein after discontinuation of the stretching of the wire a second web of natural fibres and synthetic staple fibres are laid on top of said first web of continuous filaments.

4. Method as claimed in claim 3, wherein said second web contains cellulose fibres.

5. Method as claimed in claim 3, wherein the second fibrous web is is dry-, wet- or foam formed.

6. Method as claimed in claim 3, wherein the second fibrous web are hydroentangled together.

7. The method as claimed in claim 1, wherein the wire is stretched to at least 150% of its original width when the continuous filaments are laid on the wire.

8. Method as claimed in claim 1, wherein after discontinuation of the stretching of the wire a second web of natural fibres or synthetic staple fibres are laid on top of said first web of continuous filaments.

9. The method as claimed in claim 1, wherein the continuous filaments are spunbound fibers.

10. The method as claimed in claim 1, wherein the continuous filaments are meltblown fibers.

* * * * *